US007981249B2

(12) United States Patent
Agarwal

(10) Patent No.: US 7,981,249 B2
(45) Date of Patent: Jul. 19, 2011

(54) SANITARY SHEETS MADE OF WASTE PAPER AND A PROCESS OF PREPARING SANITARY SHEET FROM WASTE PAPER

(76) Inventor: Sanjiv Agarwal, Kolkata (IN)

( * ) Notice: Subject to any disclaimer, the term of this patent is extended or adjusted under 35 U.S.C. 154(b) by 351 days.

(21) Appl. No.: 12/093,139

(22) PCT Filed: Nov. 28, 2005

(86) PCT No.: PCT/IN2005/000378

§ 371 (c)(1),
(2), (4) Date: May 9, 2008

(87) PCT Pub. No.: WO2007/060679

PCT Pub. Date: May 31, 2007

(65) Prior Publication Data

US 2009/0050281 A1 Feb. 26, 2009

(51) Int. Cl.
*D21H 19/00* (2006.01)
*D21H 19/80* (2006.01)
*B05D 3/06* (2006.01)

(52) U.S. Cl. ..... 162/119; 427/258; 162/192

(58) Field of Classification Search ..... 427/258; 428/206; 162/119, 192

See application file for complete search history.

(56) References Cited

U.S. PATENT DOCUMENTS

| | | | | |
|---|---|---|---|---|
| 2,118,549 | A * | 5/1938 | Cochrane, Jr. | 428/506 |
| 2,974,058 | A * | 3/1961 | Pihl | 427/258 |
| 3,663,689 | A * | 5/1972 | Karnaky et al. | 424/45 |
| 4,170,681 | A * | 10/1979 | Edwards et al. | 428/205 |
| 4,952,426 | A * | 8/1990 | Guttag | 427/258 |
| 5,262,224 | A * | 11/1993 | Ozaki et al. | 428/195.1 |

* cited by examiner

*Primary Examiner* — Matthew J Daniels
*Assistant Examiner* — Anthony J Calandra
(74) *Attorney, Agent, or Firm* — Baker Botts L.L.P.

(57) ABSTRACT

This invention relates to an improved smudge free sanitary sheet made of waste paper and a process of preparing the same through processing the surplus newsprint and more precisely processing used/recycled paper. The sanitary sheets are prepared by the process steps of collecting pre-consumer overprint or post consumer read newspapers; grading the collected waste newspaper; drying and sterilizing the graded newspaper by applying ultraviolet, infrared and/or gamma rays; trimming and cutting the dried sterilized sheets in appropriate sizes; applying on at least one of the sides of the waste newspaper an aqueous coating comprising of a mixture of resin such as bleached shellac, a dye, a germicide such as Benzaikonium Chloride (BC) and/or PCMX (Chloroxylenol), a safe colour, a known deodorant and optionally cosmetic chemicals such as emollient and a foaming agent such as a detergent.

22 Claims, No Drawings

SANITARY SHEETS MADE OF WASTE PAPER AND A PROCESS OF PREPARING SANITARY SHEET FROM WASTE PAPER

FIELD OF INVENTION

The present invention relates to Sanitary Sheets made of waste paper and a process for preparing sanitary sheet through processing the surplus newsprint. More precisely, it relates to a process of making sanitary sheet on raising/recycling paper.

BACKGROUND OF THE INVENTION

Paper is widely used in sanitary applications like toilet paper, paper towels, diapers, sanitary napkins and the likes. In most of such applications, virgin or partly recycled plain paper is used. As the sanitary paper is intended for single-use, a huge amount of paper is wasted after such uses. Moreover, most of the papers used for sanitary purpose, is not suitable for recycling. All these lead to the need for providing a less costly and less hazardous sanitary paper, keeping a consideration on the environmental protection because paper is made from wood pulp, in a very energy intensive process.

In some cases, alternative reusable material like fabric is used in sanitary conditions such as aprons and sheets in clinics. These aprons and sheets have to be sent for sterilization and washing even after momentary single use for example in outpatient departments and x-ray clinics, making them sometimes prohibitively costly. Still the sanitation level achieved may not be very high due to multiple uses.

On the other hand, a huge quantity of waste newsprint is available as pre-consumer surplus such as Over-issue News and post consumer read newspapers, everyday. The printed newsprint in the form of newspaper has many advantages like large size, huge everyday availability as read or surplus etc. But the toxicity of ink prohibits its sanitary application, as it may create skin irritation due to prolonged contact. Moreover, an untreated newsprint may not be acceptable from other hygienic as well as aesthetic point of views. None of the invented prior art teaches how to reuse printed newsprint in the above application, without the energy intensive costly techniques of re-pulping and remaking. Newsprint recycling techniques in which the printed-paper is pulped attain and used as a raw material for papermaking are widely known and practiced. These are highly energy intensive recycling methods that fail to teach how to process newsprint to be applicable for sanitary use without re-pulping.

U.S. Pat. No. 4,952,426 teaches the use of newspaper with a transparent plastic coating to reduce skin attack and cancer risk from the exposure of toxic printing ink such as plastic coating being applied while the ink is wet during printing of newspaper.

A huge amount of other waste paper like light weight coated (LWC) paper is also available in both the stages of pre-consumer and post-consumer use.

OBJECTS OF THE INVENTION

Therefore, the present invention aims of using these coatings on surplus printed newsprint and thereby make the newsprint safe for reuse is a quite unintended use of coating on a equally unintended surface that is newsprint and mat too used. The treatments disclosed above, apart from protecting against toxic ink also provides a barrier against any contamination left in the reused sheet. It also makes the sheet stronger, smudge-free and aesthetically more acceptable.

It is another object of the invention wherein the sheet may be folded in the known jig-jag manner and dispensed through a dispenser operating in the same way as the known dispenser for paper towels. The sheet may be further folded in a 'z' fold for making the final product even smaller for ease in carrying etc.

According to another object of the invention the cant in making sanitary sheets is reduced substantially. By contemplating reuse of waste newsprint such as surplus left with the printer and publisher, the invention achieves environment friendly and also preventing health hazardous which are not disclosed in the prior art. Overprint coatings are used for Aesthetic purposes generally for increasing gloss. As the newsprint surface is very uneven and porous, these coatings are not suitable for application in newspapers, as these fail to impart any gloss on it. Therefore, a person skilled in the art will be left from any idea of using aqueous coatings on newsprint.

Accordingly to yet another object of the present invention is to use of surplus printed newsprint that will be otherwise discarded as waste. At present the waste newsprint is mostly recycled by re-pulping in a paper mill. That is highly energy intensive. The present invention builds upon the size of printed newsprint widely available everyday as surplus or waste after reading. It also builds upon relatively higher controllability of hygiene in the way that surplus newspapers may be collected for reuse. Both the factors are unique to newspapers only and hence it will not be generally obvious to contemplate use of any waste papers as such.

BRIEF DESCRIPTION OF THE INVENTION

Pre-consumer waste newsprint discarded as scrap at printer (e.g. over-issue news) and/or at various levels in the distribution chain is collected. Post-consumer waste newsprint in good condition, i.e. read newspaper foil sheets may be collected through known methods such as putting the surplus newspapers in a particular slot or carton for daily, weekly or monthly collection. The collected newspapers are men sorted for various conditions such as size, age etc. Then the selected newspapers may be passed through a drying and sterilization process such as UV and/or Gamma ray irradiation. The dry/sterilized paper is men stacked and trimmed in the required sizes. Then these are sheet-fed into an overprint coating device that applies an imprint on it. The overprint is of a skin-safe and environment friendly coating such as FDA grade Aqueous coating or Bleached Shellac based coating. The coatings may have additives like a germicide, colorant emollient etc. then the sheets may be used a sanitary paper stock and various items may be made of these. For example a toilet seat cover is made by punching a slot using dies, to provide the opening. In that case, the sanitary sheet used has on its reverse side a blistered overprint for gluing effect when applied on the toilet seat. The coating is applied using known technique to suit the requirement, such as overprinting, spraying, Doctor Blade application etc. Since aqueous coatings are generally not suitable for application on newsprint as they do not impart much gloss on its surface, the present formulations of such coatings do not take into account run-ability of newsprint. Therefore, the coating is suitably formulated for right viscosity and other properties for better application in this process, by varying the water content and/or addition and alteration of other additives. Additional drying techniques such as hot air application, wet air extraction and/or IR light is used. If desired, a mineral powder or talc may be employed for faster drying and/or better surface qualities. In certain applications spot coating technique may be employed. For example, if the sheet is to be used for making toilet seat linings, only a portion of the sheet approximating the toilet seat may be coated.

In another embodiment the cut sheets are passed through the known off-machine or offline Calendaring or Super-calendaring process suitably modified, to glaze the surface and heat-treat the sheets at the same time, as the process raises the temperature of the sheet to a high level. In that case, the sheet is not to be coated if it is intended for non intimate use like a barrier sheet for hospital seat, because the sheet is already sterilized and smudge-free.

In another embodiment, the cut sheets are passed initially through an abrasive process to erase some of the surface ink and other particles and roughen the paper surface at the same time, which is desirable in case the treated sanitary paper is converted into a product that requires high absorption qualities.

However, the critical factors are possibility of smudge and toxicity of newsprint ink due to which a person skilled in the art is handicapped from the idea of using newspapers directly. The present invention solves the problems by contemplating use of overprint varnishes that are widely used for a very different purpose viz. for aesthetics and protecting the printed matter on which these are over-printed. Here again a technical problem is encountered because most of the varnishes are also toxic and/or not environmentally safe. This problem is solved by contemplating use of food grade varnishes such as aqueous coatings or bleached shellac varnish are used in food packaging as per food safety regulations such as FDA in US. Due to the technical problems at various levels as discussed, a person ordinarily skilled in the art is likely to be prejudiced against the use of printed newspaper in the present context.

This invention contemplates the use of decorative coatings generally used in printing and good packaging in a different context i.e. for making the waste newsprint safe for skin contact. Certain properties of these coatings may be further adjusted keeping in view the purpose, for example a satin finish may be preferred over gloss and a germicide and other additives are added. As the opacity is not mat much a concern in this application, a new variety of coating may be developed with all protective features of those mentioned earlier but less transparent and hence cheaper.

There are some coatings used directly on the foodstuff like glaze on the sweets. These are food-grade coatings such as Bleached Shellac coating derived from natural products. These overprint coatings are not considered suitable for application on newsprint surface because it is very crude and porous and the coating will fail to impart any gloss on it. Therefore, the technical specification of such coatings expressly excludes their use on Newsprint.

The present invention contemplates use of safe coatings in a very different context. To make a discarded printed sheet such as newspaper safe for reuse as a barrier such as toilet seat cover, table mat, single use protective barrier for seats or beds used in a public situations like in clinics, x-ray table etc. For safe and commercial use of sanitary sheets by the users the product should be nontoxic for human skin, smudge free, porous, skid resistance, protective, aesthetic and devoid of bad smell and strength.

The coating apart from providing the barrier against toxicity of printer's ink, will provide a barrier against smudge too. Suppose if the sheet was printed with a vegetable dye that is not toxic, still the coating provides an advantage in making it smudge-free. It also makes a raw sheet that is porous, relatively impermeable. It also sanitizes the sheet of any contamination at the time of first use, subsequent storage and/or transport for second use. It also impart an aesthetic appeal to the used sheet, by manipulating various known techniques to impart texture, skid, glue effect etc. Since edibility is not a concern here, a suitable germicide such as Benzalkonium Chloride (BC) or PCMX (Chloroxylenol) are added in the coating. (BC is widely used in cosmetic industry as a FDA approved antiseptic. PCMX is known to be used as a preservative in Aqueous coating cans, and in paper processing as a preservative in susceptible coats). Likewise, since transparency is not a concern, a safe color is added for aesthetic reasons. The germicide itself has a color or vice-versa, e.g. an antiseptic dye like Gentian Violet or Methylene Blue in very low dilution are used. Apart from imparting germicidal properties, this will also act as a preservative for coated sheets. The toxicity of printer's ink that is generally considered a constraint also add to these properties. A perfume/deodorant is added to neutralize the smell of coating and/or the substrate. Additionally, other cosmetic chemicals like tea tree oil and other emollients are also added to increase protection and appeal.

According to the invention there is provided an improved smudge free sanitary sheet made of waste-paper in particular waste newsprint cut in size, on which at least, a water proof coating on at least one of its two sides of printing comprising a bleached shellac varnish with a non toxic vegetable dye, a germicide such as Benzalkonium Chloride (BC) and/or PCMX (Chloroxylenol), a safe addition of color, and a deodorant, and optionally cosmetic chemicals is applied.

The newsprint sheet that has been already used as a sanitary sheet is discarded in various ways, as these will be fully biodegradable due to use of safe coatings. For example, the used sheets are folded back and safely collected in a disposal box provided for eventual disposal as bio-degradable municipal garbage. Where a separation is possible, the used covers in the garbage may be separated with other waste paper garbage, baled and sent for further recycling in a paper mill. Alternatively, as newsprint has relatively low wet strength, the used sheet is flushed down. There is laid instructions printed on the sheet about how to dispose off the used sheet. The instruction encourage a user to dispose off in a particular bin or suggest tearing the used sheet along folds or weakened tear lines, before flushing down the commode.

The present invention also relates to a process of recycling waste paper in making sanitary sheets comprising;

collecting pre-consumer overprint or post-consumer read newspapers;

grading the collected waste newspaper;

drying and sterilizing the graded newspaper by application of Ultraviolet, infrared and/or Gamma rays;

trimming and cutting the dried sterilized sheets in appropriate sizes;

applying on at least one of the sides of the waste newspaper an aqueous coating comprising of a mixture of resin such as bleached shellac, a dye, a germicide such as Benzalkonium Chloride (BC) and/or PCMX (Chloroxylenol), a safe color, a known deodorant, and optionally cosmetic chemicals such as an emollient.

EXEMPLARY APPLICATION OF THE INVENTION

In a preferred embodiment formulation for the mixture applied on a printed sheet includes an aqueous coating having about 40 to 50% solids generally containing a Polymeric Resin, a Surfactant and Additives like Solvents and Wax or Silicon to impart properties like son-skid and rub-resistance. About 3 to 6 lb coating is applied per side, using a meter sized press with a short dwell-time preferably, considering the high amount of Kraft pulp in the regular newsprint which makes its surface very uneven porous and highly absorbent, further leading to runability problems. In case of a difficult substrate, multiple layers of coatings are applied, in which the pre-coat also consists of a Carbonate and/or a surface sizing agent such as starch. Conventional talc is applied afterwards to improve the barrier as well as cosmetic properties of the coated sanitary sheet. The coated sheet as above is dried using medium wave IR lamps, at 90 to 95 degree centigrades and kept in the press for 24 hours for complete drying and stabilizing. Flow of dry air is maintained throughout, preferably.

For example, the formulation of the coating in a preferred embodiment has the following constituents, properly mixed and applied on a 45 gsm printed pre-consumer over-print waste newspaper, without any limitations:

PCMX (Chloroxylenol B.P.) or Benzalkonium Chloride 2%

Pine Oil or Tea-tree oil 0.1%

Potassium coconut oil soap 0.1%

A colorant such as Sunset Yellow and a deodorizer such as Cologne, as required and die rest an aqueous Coating composition such as CG702 of DIC India Ltd.

The coated sanitary sheets as described above find application in a huge variety of areas. For example, a fully coated sheet is used as a single use barrier such as in outpatient beds of clinics or on x-ray tables. In another example, it is used for making safe paper bags for carrying dry stuff. The coated newsprint may be presented in different sizes and formats to suit various requirements for example in a wide roll with a cutter attached, for using cut pieces as a barrier, say like a mat on a publicly used seat like in a gym. These can be widely used in other situations like pet care, without fears of toxicity in the newsprint ink.

By altering the micro-pores left on the coated surface, the coated newsprint is adapted for use as paper towel, toilet paper etc. also, because the newsprint inside the coat is highly absorbent. Defoamers or anti-foaming agents are used for reducing the foam that leaves micropores in the aqueous coat. The micropores adversely affect the glaze and barrier properties of the coat. By limiting or altering the use of anti-foaming agents and/or adding foaming agents, the pores are left at a threshold where water can soak in to the sheet but still hands will not get the smudge due to barrier properties of the coating.

The coating will also increase the wet strength of newsprint, which is desirable as newsprint has low wet strength. The toilet roll made of treated newsprint will be still flushable if the coat properties are adjusted to not increase the wet strength beyond what is acceptable. Likewise, the coat is modified to provide a much higher wet strength desirable in case of paper towels.

The modified higher wet strength used newsprint find use even in sanitary towels like female sanitary napkins, child diapers, adult incontinence products etc. For a simplistic example, an outer pouch made of hydrophobic material having micro-pores on one side and waterproof barrier on the other side, containing a folded or multilayer of treated newsprint as described above provide a cheaper but equally effective alternative to present processes. Alternatively, selected waste paper properly sterilized such as thorough Gamma irradiation or Autoclaving techniques is used as filler between a single or multi-walled linings for example in making highly absorbent sanitary pads such as those used in adult Incontinence and menstrual pads. In this case, known absorbent fibers or chemicals are added to enhance the properties of the pad. These pads will be much more cost effective and readily degradable and environment friendly compared to conventional pads, which use man made fibers like bleached rayon that is also known to produce allergic reactions due to dioxins produced by bleached synthetic fibers in it. In contrast, the natural wood pulp based absorbents are considered safer. Moreover, disposal of used pads remain a big headache in case of these artificial fibers whereas the substitute contemplated here is water dispersible and fast degradable. The waste paper selected for this purpose is of pre-consumer chlorine-free paper carefully collected from known sources. The top lining of such pads may be known conventional lining or a lining of virgin paper coated with highly lipophilic coating safe for ingestion. Another way of using partly treated/sterilized sanitary sheet as per the above disclosed process is as filler/underlay, covered with an overlay sheet used in conventional sanitary papers, on at least on one side, in a multi-layered configuration, each individual sheet may act like an absorbent sacked in waterproof coat that allows liquid in through its micro-pores. If many such sheets are used in making a sanitary pad instead, the sides of all such sheets is fused together and covered with an impermeable lining as conventionally done.

Variable for determining absorption of liquid by a sanitary pad is expressed by the density of the surface of the sheet or pad, sizes of the micro pores, dry thickness of the sanitary pad etc.

In the present invention the micro apertures of the sanitary pad made of sanitary sheets is maintained between 60 to 100 micron opening and the multi-layered sanitary pad is maintained in its core a density of 1.5 to 1.8 gm/cc. The micro apertures of the sanitary sheet is controlled, depending on its use by varying addition and/or alteration of additives during coating.

Therefore, it is apparent from the foregoing description that the disclosed process is a tremendous improvement over well-known industrial method of reusing printed sheet in re-pulping and making an inferior grade paper from the pulp which is highly energy intensive. Though crude reuse of newspapers is practiced, the hazards remain in it, like in domestic packaging and small business packaging including foodstuffs especially in developing countries. As the coating cost is lower than the fiber cost in the paper, the process has immense economic potential. The above process takes care of these hazards on an industrial scale and may become a mandatory standard for reuse of printed sheets especially where there is an intimate contact with the used sheet. Moreover, most of the sheets reused as per above invention can still be recycled as per existing method of re-pulping and remaking, due to careful selection of material used in the coat. Thus it is claimed that the above invented process can be readily applied commercially, especially in view of wide-spread awareness of environment pollution and need for more recycling. These will also provide a ready substitute for plastic bags generally used for retail packaging, by making reuse of previously printed newsprint possible, by altering many of it's properties like toxicity, strength, aesthetics etc. acceptable, as per the disclosed invention.

The invention described above should not be contemplated in restrictive manner as many alterations and modifications are possible within the scope and limit of the appended claims.

I claim:

1. An improved smudge free sanitary sheet made of waste newsprint dried, sanitized and cut in size, on which at least on one of its two sides of printed surface a water resistant aqueous coating is applied, the said coating comprising of a mixture resin, a dye, a germicide, a colour, deodorant, and optionally cosmetic chemicals, wherein the waste newsprint is previously printed paper coated with a mixture of an aqueous coating, germicide, a dye and an emollient.

2. An improved sanitary sheet as described in claim 1 wherein the dye and the germicide are the same.

3. An improved Sanitary sheet as claimed in claim 1 wherein the said cosmetic chemicals are tea tree oil and/or neem oil.

4. An improved sanitary sheet as described in claim 1 wherein the said sheet is obtained by recycling selected printed newspaper sheets, the selected printed newspaper sheets being passed through drying and sterilization steps including at least one of UV, infrared and/or Gamma ray irradiation and then stacked and trimmed in required size.

5. An improved sanitary sheet as claimed in claim 1 wherein the said coating acts as a human contact barrier from the toxic print of newsprint.

6. An improved sanitary sheet as claimed in claim 1 wherein the sanitary sheet is formed into a paper bag, a toilet mat lining or formed as multilayered absorbent pad in child care diapers or formed into sanitary absorbent pads with at least one absorbent overlay and at least one, waterproof underlay using multiple layers of selected and sterilized waste paper as filler.

7. An improved sanitary sheet as claimed in claim 1 wherein printed recycled waste trimmed sheets are treated through a sheet fed calendaring or super calendaring or super calendaring means, before applying the coating.

8. An improved sanitary sheet as claimed in claim 1 wherein the aqueous coat has foaming agents to leave micropores of desired size and density, to make the sheet highly absorbent.

9. An improved sanitary sheet as claimed in claim 1 wherein the resin is bleached shellac, the dye is gentian violet, the germicide is selected from a group of materials consisting of gentian violet, Benzalkonium Chloride (BC) and PCMX (Chloroxylenol), or combinations thereof, the optionally cosmetic chemicals are selected from a group of materials including emollients.

10. An improved sanitary sheet as claimed in claim 1 wherein the waste newsprint is a broadsheet or tabloid size newspaper formed into a Toilet Seat Cover.

11. An improved sanitary sheet as claimed in claim 6 wherein many sanitary sheets are formed into multilayered sanitary pad, the sides of such all sheets are fused together and covered with a conventional impermeable lining, in which each individual sheet acts like an absorbent sack with a water—resistant coat that allows liquid in through its micropores.

12. The multilayered sanitary pad of claim 11, wherein at least some layers are provided with micro-apertures of 60 to 100 microns opening.

13. A process of recycling waste paper in making sanitary sheets comprising:

collecting pre-consumer overprint or post-consumer read newspapers;

grading the collected waste newspaper;

drying and sterilizing the graded newspaper by application of Ultraviolet, infrared and/or Gamma rays;

trimming and cutting the dried sterilized sheets in appropriate sizes;

applying on at least one of the sides of the waste newspaper an aqueous coating comprising of a mixture of resin, a dye, a germicide, a safe colour, a known deodorant, and optionally cosmetic chemicals and a foaming agent.

14. The process as claimed in claim 13, wherein the optionally cosmetic chemicals and the foaming agent are the same.

15. The process as claimed in claim 13, wherein the application of aqueous coat is only on designated areas of the newspaper, to make a toilet seat cover.

16. The process as claimed in claim 13, wherein the coating is food grade comprising bleached shellac varnish with food grade additives means.

17. The process as claimed in claim 13, wherein the coating is a satin finish and skid resistant.

18. The process as claimed in claim 13, wherein a mineral powder or talc is applied for faster drying or better surface qualities.

19. The process as claimed in claim 13, wherein multiple layers of coating are applied, in which the pre-coat contains a Carbonate or starch.

20. The process as claimed in claim 13 further comprising erasing the surface ink and other particles from the said waste paper sheet at least partially.

21. The process as claimed in claim 13 further comprising calendaring or super-calendaring the said waste paper sheet.

22. The process as claimed in claim 13 wherein the resin is bleached shellac, the dye is gentian violet, the germicide is selected from a group of materials consisting of gentian violet, Benzalkonium Chloride (BC) and PCMX (Chloroxylenol), or combinations thereof, the optionally cosmetic chemicals are selected from a group of materials consisting of an emollient, a detergent, and a coconut soap, or combinations thereof, the foaming agent selected from a group of materials consisting of a detergent and a coconut soap or combinations thereof.

* * * * *